US008549963B2

(12) United States Patent
Chuang

(10) Patent No.: US 8,549,963 B2
(45) Date of Patent: Oct. 8, 2013

(54) TORQUE SOCKET

(76) Inventor: Wei-Chieh Chuang, New Taipei (TW)

( * ) Notice: Subject to any disclaimer, the term of this patent is extended or adjusted under 35 U.S.C. 154(b) by 192 days.

(21) Appl. No.: 13/310,766

(22) Filed: Dec. 4, 2011

(65) Prior Publication Data

US 2012/0240734 A1 Sep. 27, 2012

(30) Foreign Application Priority Data

Mar. 24, 2011 (TW) ..... 100205238 U

(51) Int. Cl.
*B25B 23/14* (2006.01)
*B25B 15/02* (2006.01)

(52) U.S. Cl.
USPC ..... 81/467; 81/475

(58) Field of Classification Search
USPC ..... 81/467, 473–478, 480
See application file for complete search history.

(56) References Cited

U.S. PATENT DOCUMENTS

| | | | | |
|---|---|---|---|---|
| 1,092,574 | A * | 4/1914 | Jansson | 464/37 |
| 7,243,580 | B2 * | 7/2007 | Frazee | 81/467 |
| 7,281,458 | B2 * | 10/2007 | Chuang | 81/475 |
| 2007/0039426 | A1 * | 2/2007 | Chuang | 81/475 |

* cited by examiner

*Primary Examiner* — David B Thomas
(74) *Attorney, Agent, or Firm* — Guice Patents PLLC

(57) ABSTRACT

The present invention relates to a torque socket, which comprises a shaft rod and a shaft cylinder. Two ends of the shaft rod are respectively axially formed with an insertion tenon and a core shaft having at least a cut groove transversally on a surface. Two axial ends of the shaft cylinder are respectively formed with a shaft slot and a sleeve slot, wherein the shaft slot allows the core shaft to be inserted therein and is formed with a buckle part corresponding to the location of the flange part; the interior of the shaft slot is radially and protrudingly formed with a friction segment for tightening the core shaft, thereby forming a preset torque value between the core shaft and the shaft slot. When the socket is used to fasten a connection unit, if the preset torque of the socket is exceeded, an idle rotation state is formed.

7 Claims, 5 Drawing Sheets

TORQUE SOCKET

BACKGROUND OF THE INVENTION

1. Field of the Invention

The present invention relates to a socket, especially to a torque socket having one end being sleeved with a manual, pneumatic or electric output rotation tool and having the other end being sleeved with a drive head.

2. Description of Related Art

For fastening or loosening a screw, a screwdriver is mostly used, the process is done by inserting the drive head at the bottom of a screwdriver into the top recess of a screw then normally or reversely rotating the grip of the screwdriver for fastening or loosening the screw, for the purpose of combining or separating various instruments.

A screwdriver mostly consists of a grip having a preset length and a drive rod having a drive head. The drive head in often designed in a flat shape or cross shape, for being mated with the flat or cross-shaped top recess of a screw, so as to fasten or loosen the screw. However, the shape and dimension of the drive head of the mentioned screwdriver is fixed and cannot be replaced by other drive heads having different shapes and dimensions. In view of the mentioned disadvantages, manufacturers in the related arts have developed a manual tool capable of changing drive head, e.g. a wrench. After the wrench is sleeved with a socket, an insertion slot at the bottom of the socket can be sleeved with a drive head having different shape and dimension, thereby being applicable to various types of screws. As such, the socket is merely served as a tool for transmitting torque without being installed with a torque mechanism with fixed value.

When using a convention rotation tool such as screwdriver or wrench to adjust the lens of an optical device, e.g. a monitor, because the torque value of the rotation tool is determined by the force applied by the user, in the adjustment process, the lens is often damaged or broken due to the excessive torque, thereby causing tremendous lost.

For preventing a user from using a rotation tool such as a screwdriver or wrench to rotate an article to be fastened, e.g. a screw, with a rotation force exceeding the range tolerable by the screw, and causing the screw deformation. As such, a screwdriver having a transmission structure configured by springs and steel balls for limiting the torque output has been developed, when said screwdriver is in use, the steel balls would separate from the springs when the torque is too large, so the screwdriver is separated from the adopted drive head, thereby forming an idle rotation state between the screwdriver and the drive head, thus the screwdriver is only allowed to output a preset torque for preventing the damage of the article to be fastened.

By using the screwdriver with the transmission performed through springs and steel balls, the output torque can be controlled at a fixed value; however, the engaging and sliding between the springs and steel balls is in point contact, so the components are fragile and deformation and damage may occur; as a result, the limited value of output torque is not stable. Moreover, the dimension of the screwdriver cannot be designed to be smaller due to the transmission structure having springs and steel balls, so said screwdriver is almost useless for the fastening operation of a precision instrument.

SUMMARY OF THE INVENTION

One primary object of the present invention is to provide a torque socket having one end being sleeved with a manual, pneumatic or electric output rotation tool, and the other end being sleeved with a drive head, wherein a core shaft and a shaft slot of the socket are provided with preset torque value, so when the socket is used to fasten a connection unit, if the preset torque of the socket is exceeded, an idle rotation state is formed for preventing damage of the connection unit and the article to be fastened, and the present invention also improve the situation that the socket used in a conventional rotation tool only provides a function of being sleeved with drive heads having different shapes and dimensions.

For achieving the mentioned objects, the present invention provides a torque socket, which comprises:

a shaft rod, one end thereof is axially formed with an insertion tenon having a non-round cross section, the other end is axially extended with a core shaft formed with at least a cut groove transversally on a surface and radially and protrudingly formed with a flange part;

a shaft cylinder, two axial ends thereof are respectively formed with a shaft slot having a round cross section and a sleeve slot having a non-round cross section, wherein the shaft slot is a stepped hole having the dimension slightly smaller than the core shaft and allows the core shaft to be inserted therein, the shaft slot is formed with a buckle part corresponding to the location of the flange part for buckling the flange part, and the interior of the shaft slot is radially and protrudingly formed with a friction segment for tightening the core shaft, thereby forming a preset torque value between the core shaft and the shaft slot.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
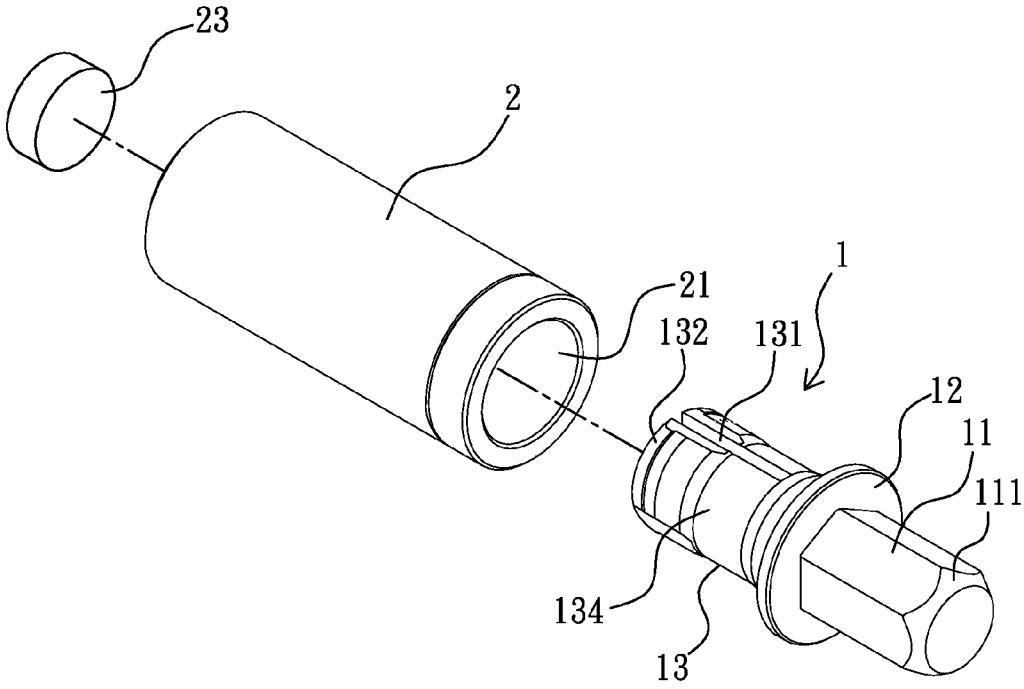
FIG. 1*a* is a perspective exploded view of the torque socket being illustrated from one angle, according to the present invention.
Figure 1B:
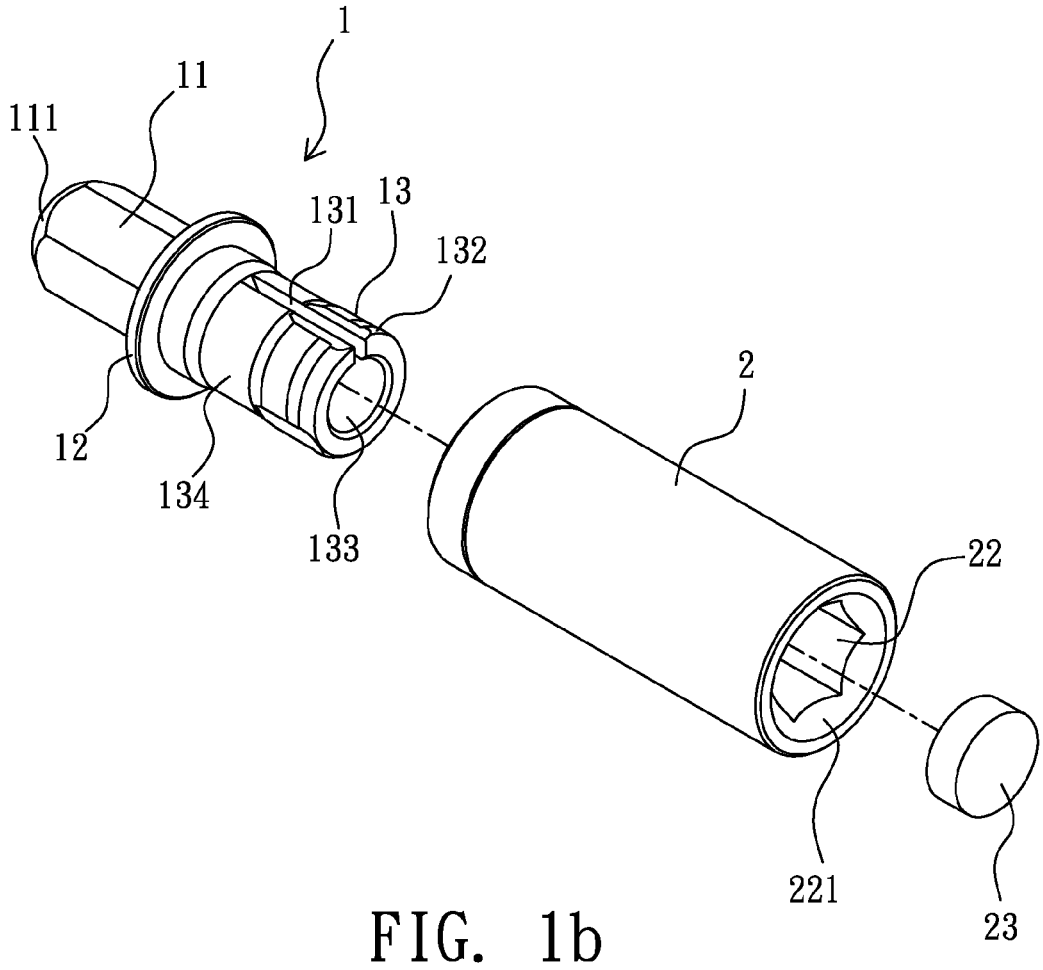
FIG. 1*b* is a perspective exploded view of the torque socket being illustrated from another angle, according to the present invention.
Figure 2:
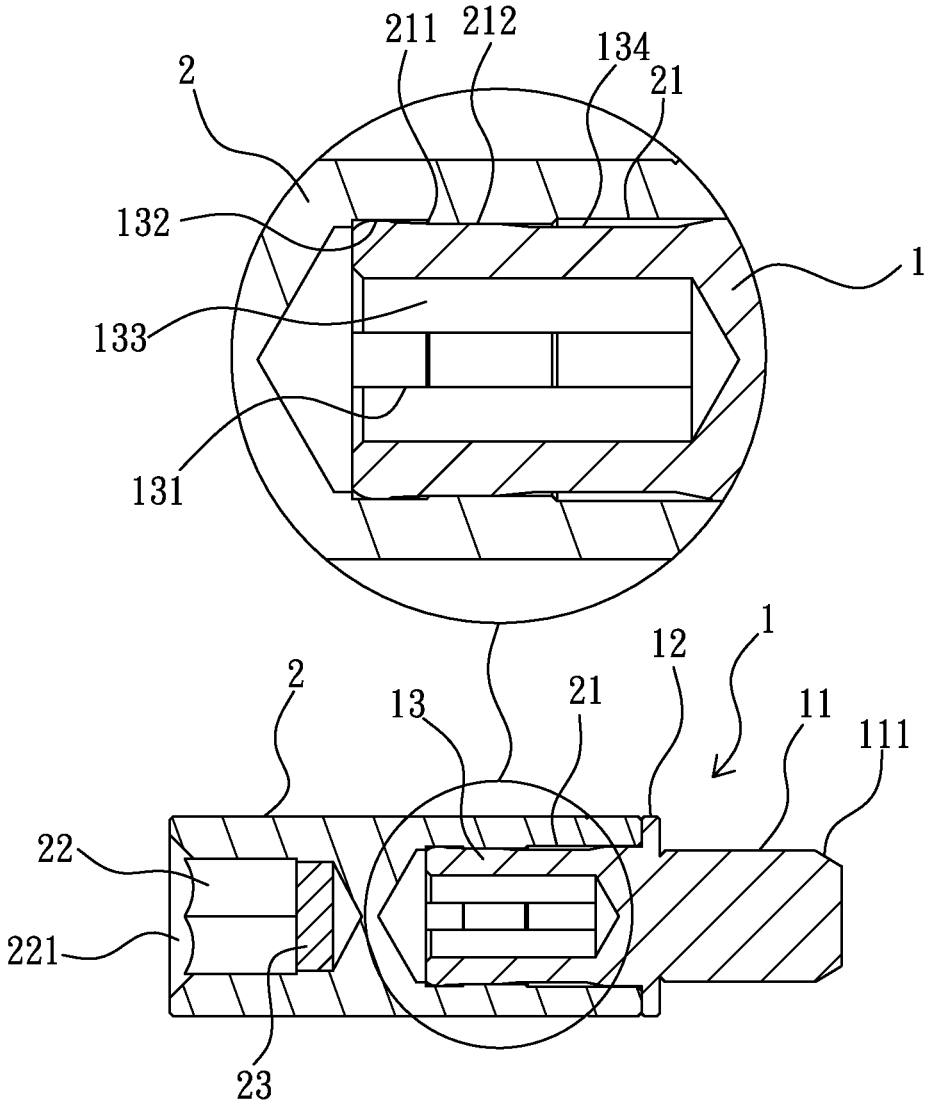
FIG. 2 is a cross sectional view illustrating the assembly of the torque socket, according to the present invention.
Figure 3:
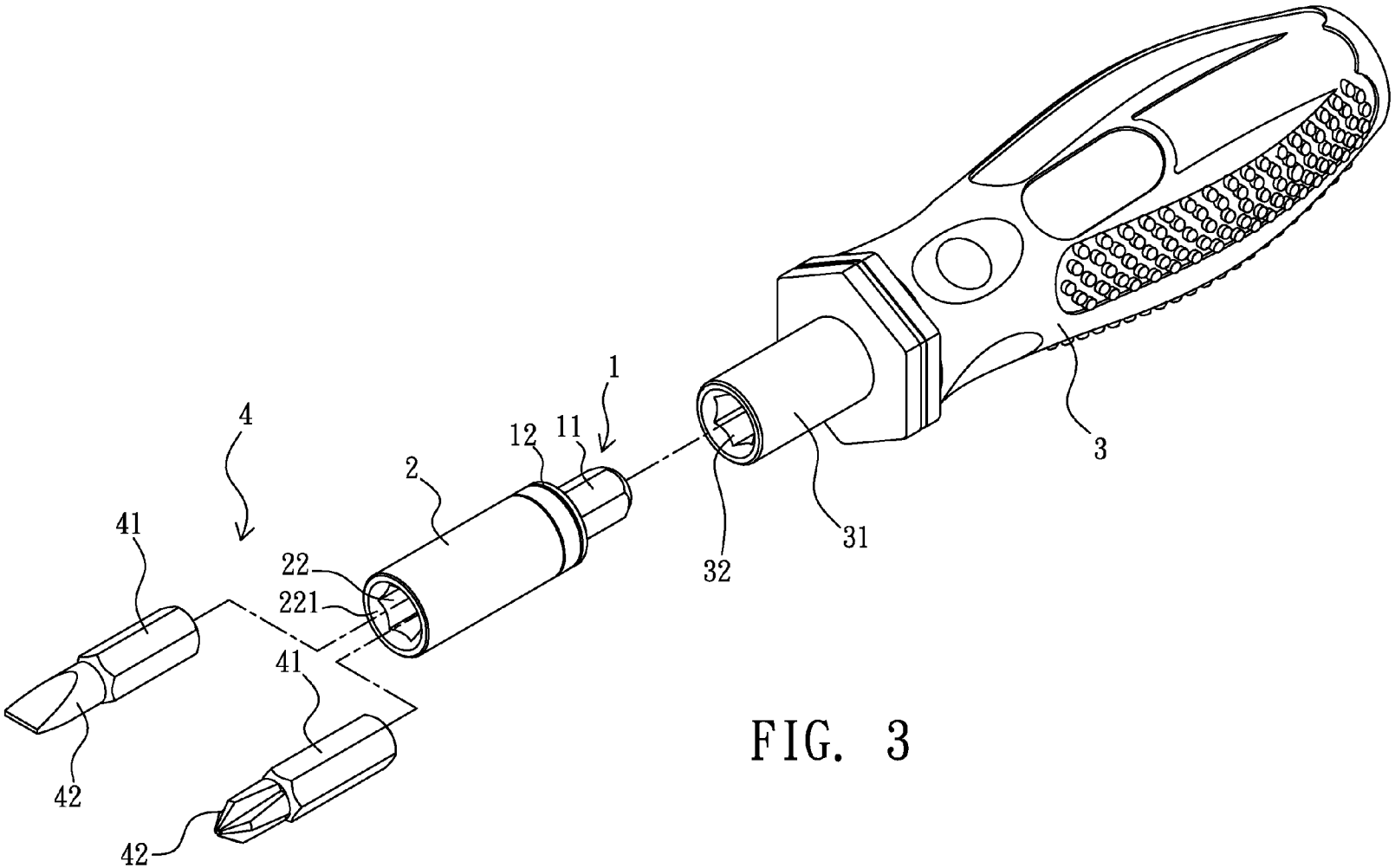
FIG. 3 is a perspective exploded view illustrating the torque socket of the present invention, a rotation tool and a drive head.
Figure 4:
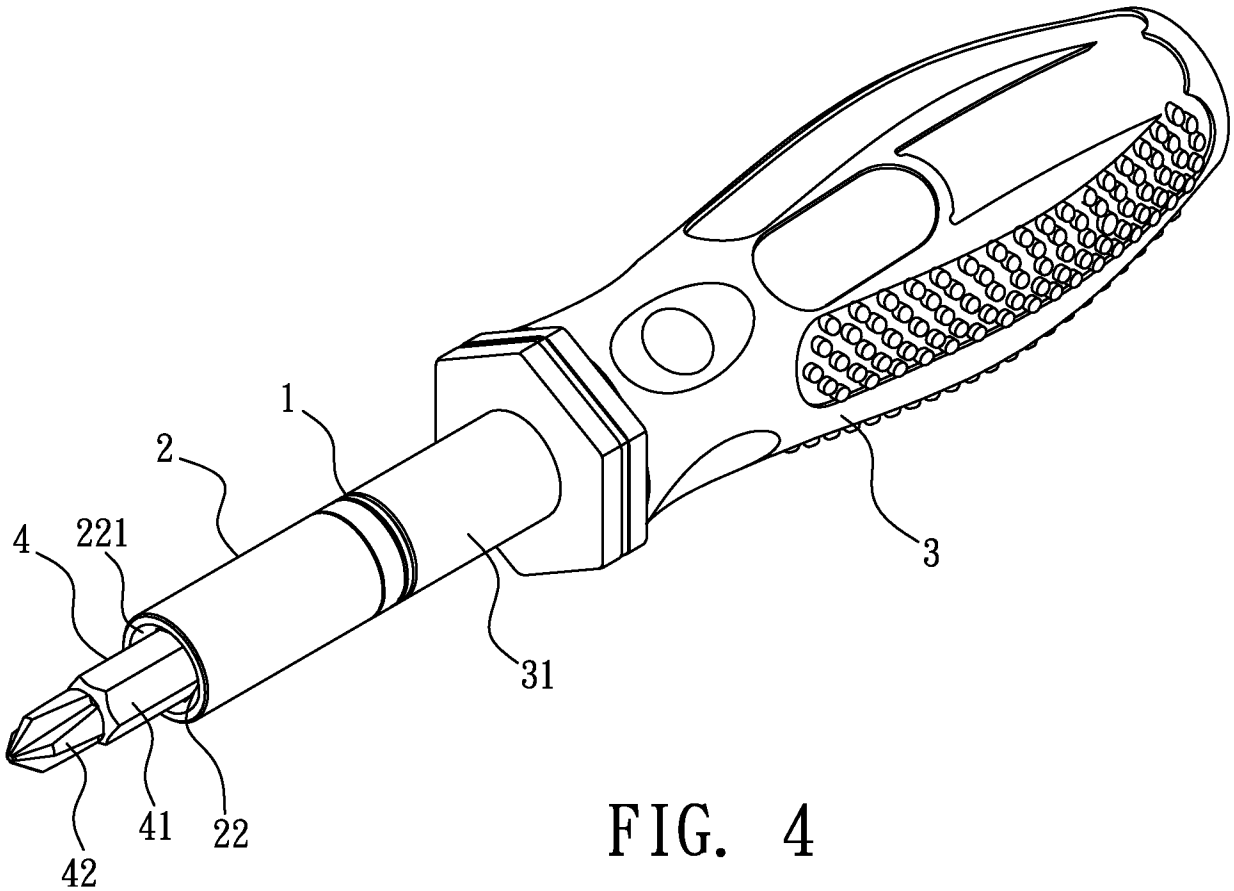
FIG. 4 is a perspective view illustrating the assembly of the torque socket of the present invention, the rotation tool and the drive head.

The accompanying drawings are included to provide a further understanding of the invention, and are incorporated in and constitute a part of this specification. The drawings illustrate embodiments of the invention and, together with the description, serve to explain the principles of the invention, wherein FIG. 1*a* is a perspective exploded view of the torque socket being illustrated from one angle, according to the present invention; FIG. 1*b* is a perspective exploded view of the torque socket being illustrated from another angle, according to the present invention; FIG. 2 is a cross sectional view illustrating the assembly of the torque socket, according to the present invention; FIG. 3 is a perspective exploded view illustrating the torque socket of the present invention, a rotation tool and a drive head; and FIG. 4 is a perspective view illustrating the assembly of the torque socket of the present invention, the rotation tool and the drive head.

As shown in FIG. 1*a* to FIG. 2, the torque socket provided by the present invention substantially comprises a shaft rod 1 and a shaft cylinder 2.

The shaft rod 1 is a rod member with one end being axially formed with an insertion tenon 11 having a non-round cross section, e.g. hexagonal, the free end defined at the top thereof is formed with a chamfer part 111 having an inclined portion for being inserted in a rotation tool 3 as shown in FIG. 3, e.g. an insertion slot 32 formed on a connection rod 31 at the bottom of a screwdriver grip.

The bottom of the insertion tenon 11 is radially formed with a ring sheet 12 for being disposed adjacent to the insertion slot 32 and a shaft slot 21 of the shaft cylinder 2. The other end of the ring sheet 12 is extended with a core shaft 13, the surface of columnar body is transversally formed with at least a cut groove 131 for providing a proper elasticity to the core shaft 13. The surface of the core shaft 13 has a flange part 132, and the center is axially formed with a rod hole 133 which is in communication with the cut grooves 131, and the interior can be filled with lubrication oil which is allowed to pass through the cut grooves 131 for forming a lubrication effect. In addition, the periphery of each cut groove 131 of the core shaft 13 is provided with an oil storage zone 134, e.g. being formed by a milling cutter, for the purpose of oil storage, thereby increasing the smooth effect while the core shaft 13 is rotating in the shaft slot 21.

The shaft cylinder 2 is a columnar body, the two axial ends are respectively formed with the shaft slot 21 having a round cross section and a sleeve slot 22 having a non-round cross section, e.g. hexagonal. The dimension of the shaft slot 21 is slightly smaller than that of the core shaft 13, such that the above two are enabled to be mounted by a conventional tightening means, thereby forming a rotation shaft structure having stopping and positioning effect. The shaft slot 21 is a stepped hole, and the interior is formed with a buckle part 211 corresponding to the location and dimension of the flange part 132 of the core shaft 13; when being assembled, the flange part 132 is buckled with the buckle part 211, so after the core shaft 13 is sleeved with shaft slot 21, a buckling state is established and the separation in the axial direction is prevented. Moreover, the interior of the shaft slot 21 is protrudingly formed with a friction segment 212 capable of tightening the surface of the core shaft 13, thereby obtaining an anticipated torque; and the torque can be adjusted to the preset torque value through altering the contact area of the friction segment 212 and the core shaft 13, thereby suitable to be used for the fastening operation of a precision instrument.

The sleeve slot 22 is provided with an inclined guide surface 221 at the periphery of the inlet end, thereby facilitating the sleeving and positioning of a sleeve rod 41 of a drive head 4 shown in FIG. 3, wherein, in actual practice, the free end of the drive head 4 can be a tenon head 42 having a flat, cross or geometric configuration, the aforesaid art a conventional art well known by skilled people, thereby no further illustration is provided. For allowing the drive head 4 to be provided with a magnetic force, a magnet 23 is installed in the sleeve slot 22, so the sleeved drive head 4 can be provided with the magnetic force to attract a connection unit made of a magnetic conductive material such as a screw.

Accordingly, the torque socket as shown in FIG. 3 is assembled through the rotation shaft structure is formed by buckling the core shaft 13 and the shaft slot 21 between the shaft rod 1 and the shaft cylinder 2. Based on what is mentioned above, the insertion tenon 11 at one end of the socket is inserted in the rotation tool 3, e.g. the insertion slot 32 of the connection rod 31 at the bottom of the screwdriver grip, and the sleeve slot 22 at the other end is sleeved with a selected drive head 4, thereby forming the combination state as shown in FIG. 4. What shall be addressed in that the rotation tool 3 is not limited to a manual screwdriver grip, i.e. the socket of the present invention can also be applied in a pneumatic or electric rotation tool and the anticipated tightening or loosening effects can also be achieved.

In actual practice, the tenon head 42 of the drive head 4 is firstly aimed at a connection unit, e.g. the top recess of a screw, installed at the periphery of a lens of the precision instrument, e.g. a monitor, then the rotation tool is rotated by a hand for processing the tightening adjustment; during the screw process, the screw can be continuously screwed in when the preset torque value of the preset socket is not exceeded, when the screw is rotated and positioned and the preset torque value is exceeded, the core shaft 13 forms an idle rotation state in the shaft slot 21, thereby preventing overly tightening the screw which may result in the lens being pressed and broken. As such, the lost caused by insufficient screwing and torque exceeding the range tolerable by the article to be tightened can be avoided.

The features of the present invention are: the socket is prevented from separating in the axial direction through the buckling effect between the core shaft and the shaft slot; the preset torque value can be determined by the friction area of the above two; the rod hole axially formed on the core shaft is in communication with the cut groove so as to guide out the lubrication oil stored therein and supply to the oil storage zone at the periphery of the cut groove, thereby enhancing the smooth effect during rotation; moreover, the socket of the present invention can be applied in a manual, pneumatic, and electric output rotation tool, thereby widening the application range and being a novel design which have never been seen before.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A torque socket, comprising:

a shaft rod, one end thereof being axially formed with an insertion tenon having a non-round cross section, the other end being axially extended with a core shaft formed with at least a cut groove transversally on a surface and radially and protrudingly formed with a flange part; and a shaft cylinder, two axial ends thereof being respectively formed with a shaft slot having a round cross section and a sleeve slot having a non-round cross section, wherein said shaft slot being a stepped hole having the dimension slightly smaller than said core shaft and allowing said core shaft to be inserted therein, said shaft slot being formed with a buckle part corresponding to the location of said flange part for buckling said flange part, and the interior of said shaft slot being radially and protrudingly formed with a friction segment for tightening said core shaft, thereby forming a preset torque value between said core shaft and said shaft slot.

2. The torque socket as claimed in claim 1, wherein a magnet is disposed in said sleeve slot.

3. The torque socket as claimed in claim 1, wherein said core shaft is axially formed with a rod hole in communication with a cut groove, and lubrication oil is provided in said rod hole.

4. The torque socket as claimed in claim 1, wherein said core shaft is formed with an oil storage zone at the periphery of each cut groove.

5. The torque socket as claimed in claim 1, wherein a free end of said insertion tenon of said core shaft is formed with a chamfer part, a guide surface is formed at the inlet periphery of said sleeve slot.

6. The torque socket as claimed in claim 1, wherein a ring sheet is radially formed between said insertion tenon and said core shaft.

7. The torque socket as claimed in claim 1, wherein said insertion tenon is inserted in an insertion slot of a connection rod formed at the bottom of a manual, pneumatic or electric rotation tool, and said sleeve slot allows a sleeve rod of a drive head to be sleeved and positioned, the free end of said drive head is installed with a tenon head having a geometric shape.

* * * * *